US008568052B2

(12) United States Patent
Haramiishi et al.

(10) Patent No.: US 8,568,052 B2
(45) Date of Patent: Oct. 29, 2013

(54) BINDER

(75) Inventors: Kiichi Haramiishi, Tokyo (JP); Masashi Shimamura, Tokyo (JP)

(73) Assignee: Max Co., Ltd., Tokyo (JP)

( * ) Notice: Subject to any disclaimer, the term of this patent is extended or adjusted under 35 U.S.C. 154(b) by 569 days.

(21) Appl. No.: 11/996,911

(22) PCT Filed: Jul. 26, 2006

(86) PCT No.: PCT/JP2006/314771

§ 371 (c)(1),
(2), (4) Date: Jan. 25, 2008

(87) PCT Pub. No.: WO2008/013509

PCT Pub. Date: Feb. 1, 2007

(65) Prior Publication Data

US 2010/0135713 A1 Jun. 3, 2010

(30) Foreign Application Priority Data

Jul. 26, 2005 (JP) ..... 2005-216314

(51) Int. Cl.

| | |
|---|---|
| ***B42D 1/00*** | (2006.01) |
| ***B42F 3/00*** | (2006.01) |
| ***B42F 13/40*** | (2006.01) |
| ***B42F 3/04*** | (2006.01) |
| ***B42F 13/20*** | (2006.01) |
| ***B42F 13/12*** | (2006.01) |

(52) U.S. Cl.
USPC ..... 402/31; 281/21.1; 281/27.1; 402/5; 402/26; 402/29; 402/58; 402/60; 402/70; 402/73

(58) Field of Classification Search
USPC ..... 281/3.1, 15.1, 21.1, 27.1, 51; 283/63.1, 283/64, 117; 402/4, 5, 26, 29, 30, 31, 32, 402/33, 34, 35, 36, 37, 38, 39, 43, 58, 59, 402/60, 68, 70, 73, 80 P, 80 R
See application file for complete search history.

(56) References Cited

U.S. PATENT DOCUMENTS

| | | | | |
|---|---|---|---|---|
| 2,399,561 | A * | 4/1946 | Murphy | 402/20 |
| 4,932,804 | A * | 6/1990 | Richards | 402/75 |
| 5,524,997 | A | 6/1996 | Von Rohrscheidt | |
| 6,062,760 | A * | 5/2000 | Whaley | 402/26 |
| 2005/0019093 | A1 * | 1/2005 | Knight | 402/39 |
| 2005/0175434 | A1 * | 8/2005 | Sakata et al. | 412/38 |

FOREIGN PATENT DOCUMENTS

| | | |
|---|---|---|
| EP | 1 512 549 | 3/2005 |
| JP | 2000-289376 | 10/2000 |
| JP | 2002-502728 | 1/2002 |
| JP | 2004-237578 | 8/2004 |
| JP | 2004-237579 | 8/2004 |
| JP | 2004-237580 | 8/2004 |
| JP | 2005-59396 | 3/2005 |
| WO | WO 92/06849 | 4/1992 |
| WO | WO03093025 | * 11/2003 |

* cited by examiner

*Primary Examiner* — Dana Ross
*Assistant Examiner* — Justin V Lewis
(74) *Attorney, Agent, or Firm* — Drinker Biddle & Reath LLP

(57) ABSTRACT

A binder includes a back part disposed between ring parts, each of the ring parts being openable and closable. to constitute a binder. A penetration hole is formed at a portion of the ring parts intersecting with the back part, thereby allowing the binder to expand and contract to a certain degree in a longitudinal direction thereof.

6 Claims, 20 Drawing Sheets

BINDER

TECHNICAL FIELD

The present invention relates to a binder for binding brochures such as documents.

BACKGROUND ART

JP 2000-289376 A discloses a plastic-made binder which is used to bind loose-leaf papers on the market or documents punched by a multi-hole puncher. This binder is a one-piece molded product in which a large number of ½ ring portions are arranged at given intervals in two lines on both sides of a back part of the binder, and the back part of the binder itself is a hinge composed of two divided sections. With the back part between the two lines, one line of ½ ring portions respectively include spherical-shaped projections on the leading ends thereof; whereas the other line of ½ ring portions respectively include in the leading ends thereof holes respectively having shapes corresponding to their associated projections. When the spherical-shaped projections and holes are fitted with each other, the two lines of paired ½ ring portions are connected together, thereby binding the loose-leaf papers.

In the field of office automation equipment, there is known a kind of composite machine which includes a copying machine and a stapler incorporated in the copying machine and is capable of carrying out operations ranging from a copying operation to a binding operation. It may be more convenient to be able to provide an automatic binding processing machine which punches holes in copied papers and attaches a binder to the copied papers. It can be estimated that potential demand for such automatic binding processing machine must be large.

To realize this type of binding processing machine, means for handling a binder is an important element. For example, it is necessary for the binder to have a structure suitable for mechanically handling or carrying out binder operations such as binder feeding, holding and fitting operations. However, the binder disclosed in JP 2000-289376 A is structured on the assumption that it is mounted by hand into a binding processing machine but not on the assumption that it is handled mechanically. Thus, it is difficult to use this binder in a binding processing machine which does not require the manual operation.

In view of this, there has been proposed a binder having a structure which is suitable for use in the binding processing machine. For example, a binder disclosed in JP 2004-237578 A is structured such that, the back part of the binder is projected forwardly or toward the back surface of the binder and thus, when a number of binders are piled up on top of each other, the back part of one binder can be contacted with the front surface or back surface of the other binder. According to this structure, even when a large number of binders are piled up on top of each other, the individual binders can be piled up in such a manner they respectively can keep their initial shapes, whereby, when the binders are loaded into a cartridge provided in the binding processing machine, the smoothness of the feeding and mounting of the binders can be improved.

Also, a binder disclosed in JP 2004-237579 A is structured such that one or more recessed portions are formed on one of the front and back surfaces of the back part of the binder, and such that one or more projecting portions to be fitted and paired with the recessed portions are formed on the other surface, whereby a plurality of binders can be connected together while they are piled up on top of each other. This structure can facilitate the handling of the piled-up binders.

Further, a plastic-made binder disclosed in JP 2004-237580 A has a scarf joint structure in which, in the end portions of sectioned ring portions to be fitted and paired with each other, there are provided symmetrical steps extending in the radial direction thereof. Further, this binder includes a hook portion on one end thereof, and a catch portion to be fitted and paired with the hook portion on the other end thereof, thereby providing means for fitting its sectioned ring portions with each other. Therefore, this binder requires less power for fitting when compared with the structure of the binder disclosed in JP 2000-289376 A in which the spherical projections are fitted into the holes. Also, according to this binder, the structure of a die for molding it can be further simplified.

Generally, the coefficient of linear expansion of plastic with respect to temperature is larger than that of metal. Moreover, a product having a large length such as a plastic-made binder varies greatly in length according to temperature. In a binder of a type that is mounted by hand, heat influences can be substantially neglected. However, in a binder which is used in a binding processing machine, since the binder is loaded into the binding processing machine, it can be influenced greatly by the heat of the binding processing machine, thereby raising a possibility that there can be generated a difference between the pitch of holes punched in the papers and the ring pitch of the binder. In this case, when the punched hole in one end of the papers and binder ring, or the punched hole in the central portion of the papers and binder ring are used as standards for positioning, the punched hole in the other end of the papers or the punched holes in the two ends thereof are shifted in position from the binder rings, which may obstruct the fitting or engaging of the binder rings.

Also, in a binding processing machine, when a binder is fed along a binder guide corresponding in shape to the shape of the front surface of the binder, if the binder expands linearly, the side surface of the ring portion is strongly contacted with the wall surface of the binder guide so that feed resistance is increased, which may result in the poor feeding of the binder.

DISCLOSURE OF THE INVENTION

Problems to be Solved by the Invention

One or one or more embodiments of the present invention provide a binder, according to which a poor mounting or a poor feeding of the binder due to a linear expansion thereof is resolved.

According to one or one or more embodiments of the invention, a binder includes a back part, and a plurality of ring parts arranged at certain intervals along a longitudinal direction of the back part on respective sides of the back part: Each of the ring parts is openable and closable. The plurality of ring parts are coupled together through the back part disposed between side surfaces of the respective adjacent ring parts. At least one of the ring parts is formed with a penetration hole at a portion intersecting with the back part so as to absorb a linear expansion of the binder in a longitudinal direction thereof.

According to one or one or more embodiments of the invention, each of the ring parts may include a center ⅓ ring part coupled to the back part, and ⅓ ring parts hinge-connected to respective ends of the center ⅓ ring part, and the center ⅓ ring parts of at least one of the ring parts may be formed with the penetration hole at the portion intersecting with the back part.

According to one or one or more embodiments of the invention, the binder may further include a position regulating portion disposed on the side surface of at least one of the ring parts. The position regulating portion is operable to contact with a wall surface of a binder guide of a binding processing machine to regulate a position of the ring parts.

According to one or one or more embodiments of the invention, a binder includes a back part, a plurality of ring parts arranged at certain intervals along a longitudinal direction of the back part on respective sides of the back part, each of the ring parts being openable and closable, and a position regulating portion disposed on a side surface of at least one of the ring parts. The position regulating portion is operable to contact with a wall surface of a binder guide of a binding processing machine to regulate a position of the ring parts.

According to one or one or more embodiments of the invention, the position regulating portion may include a projecting portion having a spherical shape.

Effects of the Invention

According to one or one or more embodiments of the invention, in a binder including a number of ring parts connected together with the back part disposed between side surfaces of the ring parts, a penetration hole is formed on at least one of the ring parts at a portion intersecting with the back part, thereby allowing the binder to expand and contract slightly in the longitudinal direction thereof. Owing to this, even when the binder expands linearly according to the environmental temperature so that the whole length thereof is varied, the linear expansion of the binder in the longitudinal direction thereof can be corrected by means for positioning the ring pitch of the binder, e.g., a ring part positioning guide or a binder holder. Thus, it is possible to eliminate a difference between the punched hole pitch of papers and the ring pitch of the binder. This can prevent the poor mounting of the binder caused by the linear expansion of the binder.

According to one or one or more embodiments of the invention, one or more position regulating portion provided on one or two side surfaces of one or more ring parts can keep the position of the ring part at a regular position even when the binder expands linearly, which makes it possible to carry out the binding operation of the binder properly.

BRIEF DESCRIPTION OF THE DRAWINGS

FIG. 3(*b*) is a front view of the binder shown in FIG. 1, showing the inner peripheral surface side of the binder.

FIG. 4(*b*) is a side view of the binder shown in FIG. 1, showing the outer peripheral surface side of the binder.

FIG. 5(*b*) is a perspective view of a large-diameter binder.

FIG. 6(*a*2) is a perspective view of a small-diameter binder with its fitting portion facing downward.

FIG. 6(*b*1) is a perspective view of a large-diameter binder with its fitting portion facing upward.

FIG. 6(*b*2) is a perspective view of a large-diameter binder with its fitting portion facing downward.

FIG. 7(*a*2) is a section view of a small-diameter binder, showing a state in which it has been fitted.

FIG. 7(*b*1) is a section view of a large-diameter binder just before it is fitted.

FIG. 7(*b*2) is a section view of a large-diameter binder, showing a state in which A has been fitted.

FIG. 8(*a*2) is a side view of small-diameter binders, showing a state in which they are piled up on top of each other.

FIG. 8(*b*1) is a side view of a large-diameter binder.

FIG. 8(*b*2) is a side view of large-diameter binders, showing a state in which they are piled up on top of each other.

FIG. 10(*b*) is a side section view of the fitting mechanism provided on and between the leading ends of the ring parts.

FIG. 10(*c*) is a side view of the fitting mechanism provided on and between the leading ends of the ring parts.

FIG. 11(*b*) is a perspective view of still another embodiment of a binder according to the invention.

FIG. 15(*a*0) is a side section view of a small-diameter binder.

FIG. 15(*a*1) is a section view taken along the A-A line shown in FIG. 15(1), showing a state in which the binder pickup unit holds a small-diameter binder.

FIG. 15(*a*2) is a section view taken along the B-B line shown in FIG. 15(1), showing a state in which the binder pickup unit holds a small-diameter binder.

FIG. 15(*b*0) is a side section view of a large-diameter binder.

FIG. 15(*b*1) is a section view taken along the A-A line shown in FIG. 15(1), showing a state in which the binder pickup unit holds a large-diameter binder.

FIG. 15(*b*2) is a section view taken along the B-B line shown in FIG. 15(1), showing a state in which the binder pickup unit holds a large-diameter binder.

DESCRIPTION OF REFERENCE NUMERALS

Figure 1:
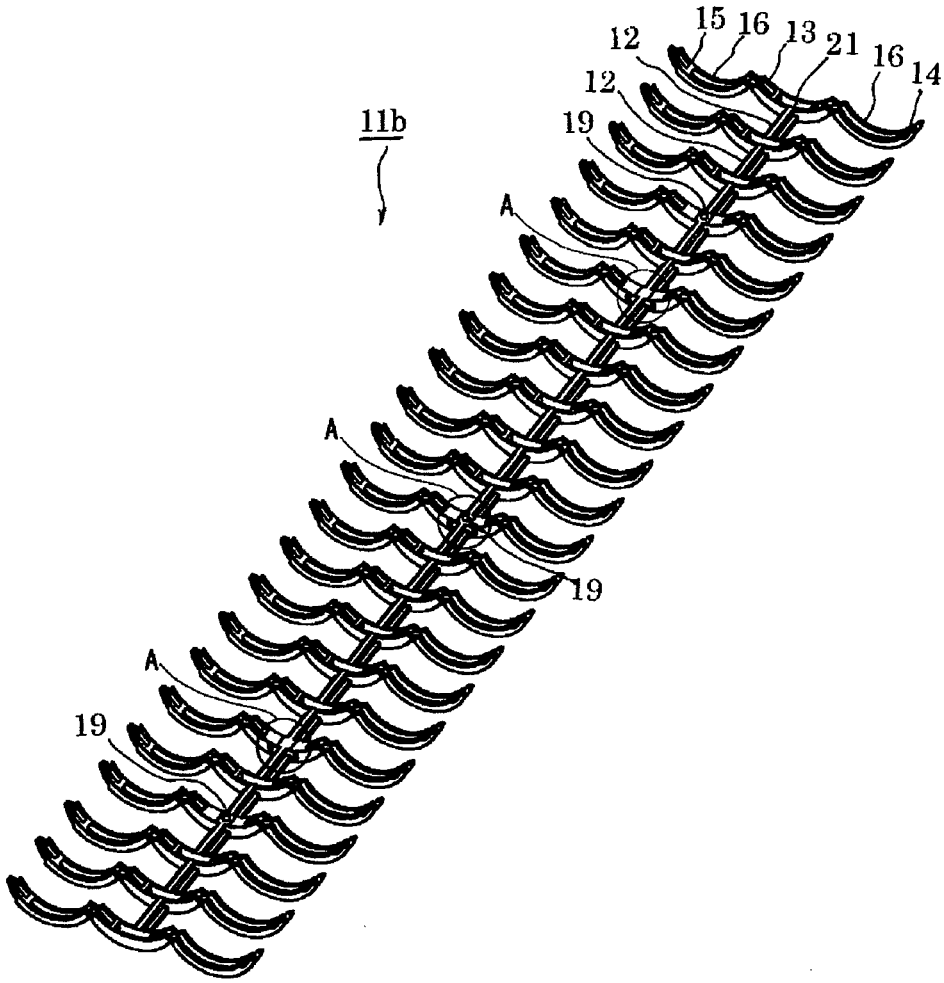
FIG. 1 is a perspective view of an embodiment of a binder according to the invention.

11*a*, 11*b*: Binder
12: Back part
13: Center ⅓ ring part
14, 15: ⅓ ring part
17: Hook portion
18: Catch portion
19: Pin
20: Pin hole
21: Penetration hole
22: Plane portion
23: Projecting portion
24, 25: Step portion
51: Binder pickup unit
52: Table block
52: Hook lever block

54: Plane table
55: Hook lever

BEST MODE FOR CARRYING OUT THE INVENTION

Embodiment 1

FIGS. 1 to 4(*b*) respectively show a binder 11*b*. The binder 11*b* is a plastic injection molded product which includes a back part 12 having a T-shaped section and ring parts 13, 14 and 15 connected to each other at given intervals by the back part 12. The ring part is sectioned into three parts, namely, a center ⅓ ring part 13 connected to the back part 12, and two ⅓ ring parts 14 and 15 respectively connected to the two ends of the center ⅓ part 13 through their respective small-thickness hinge portions.

Figure 3A:
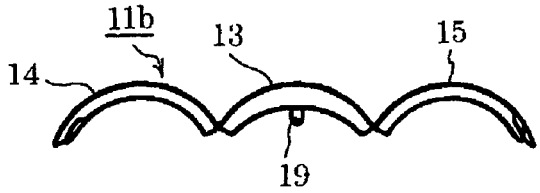
FIG. 3(*a*) is a side view of the binder shown in FIG. 1, showing the inner peripheral surface side of the binder.
Figure 3B:
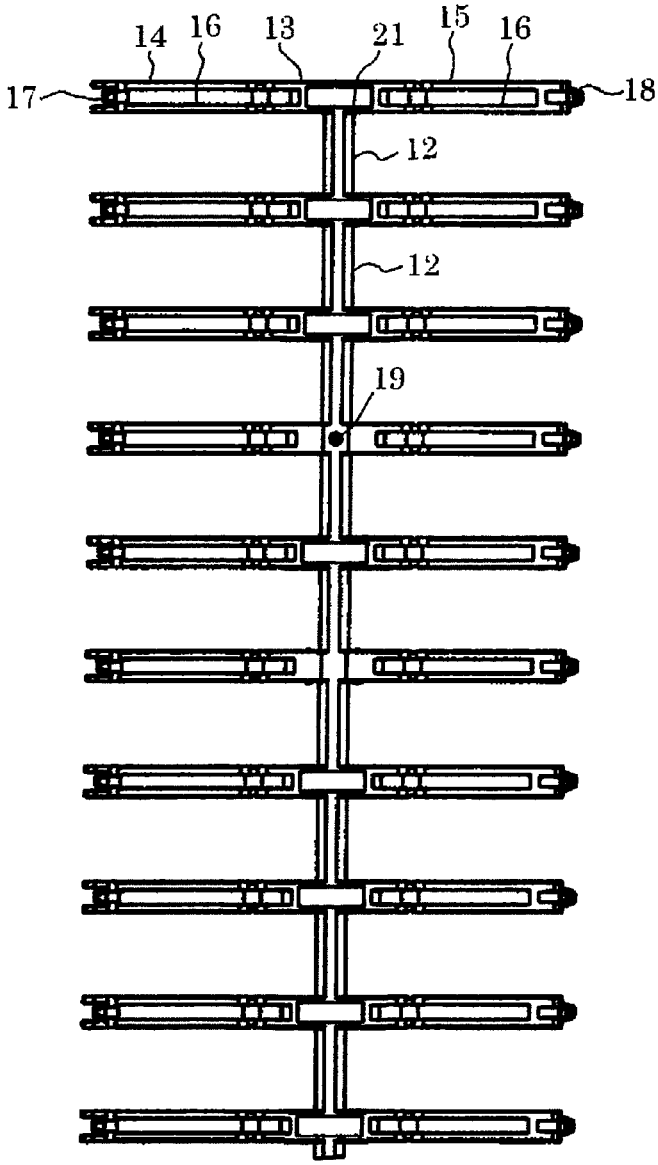

As shown in FIGS. 1 and 3(*b*), grooves 16 are formed on the inner peripheral surfaces of the ⅓ ring parts 14 and 15 so as to extend in the circumferential direction of the ring part. A hook portion 17 is formed on the leading end of one ⅓ ring part 14, and a catch portion 18, with which the hook portion 17 can be fitted, is formed on the leading end of the other ⅓ ring part 15. In operation, the paired ⅓ ring parts 14 and 15 are rotated about the hinge portions, and their respective hook portion 17 and catch portion 18 are fitted with each other, thereby forming a complete ring.

Figure 2:
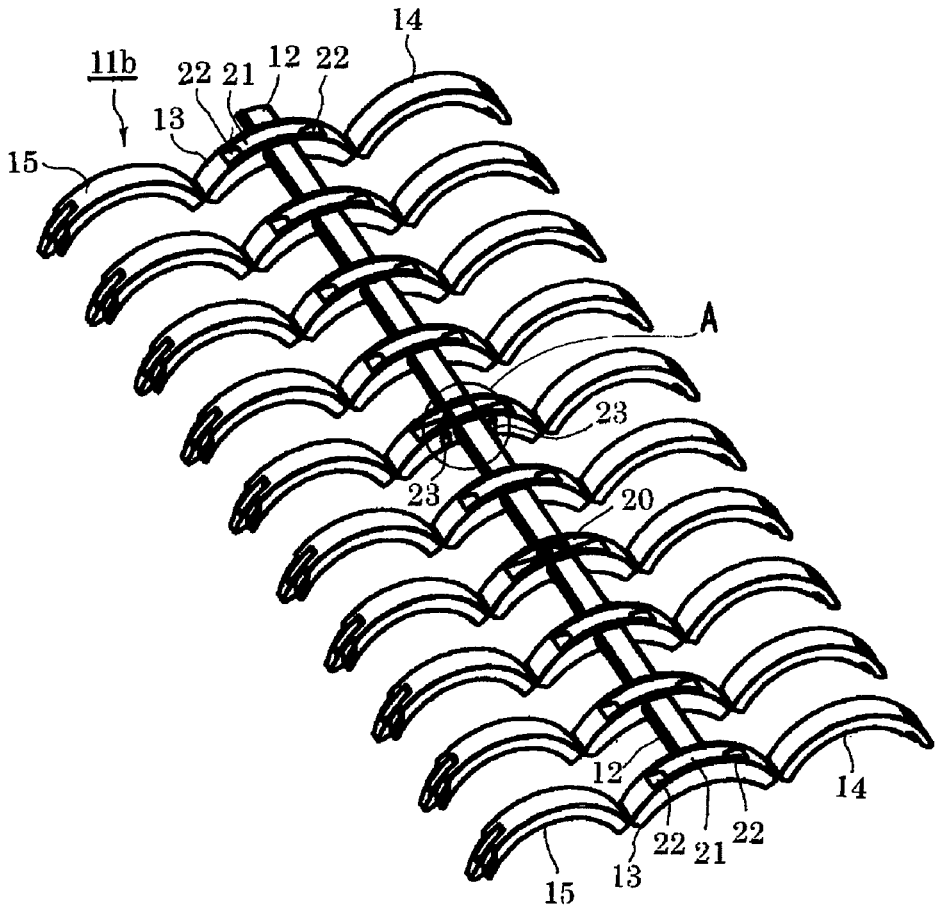
FIG. 2 is a perspective view of the binder shown in FIG. 1, showing a state in which the binder is reversed upside down.
Figure 4A:
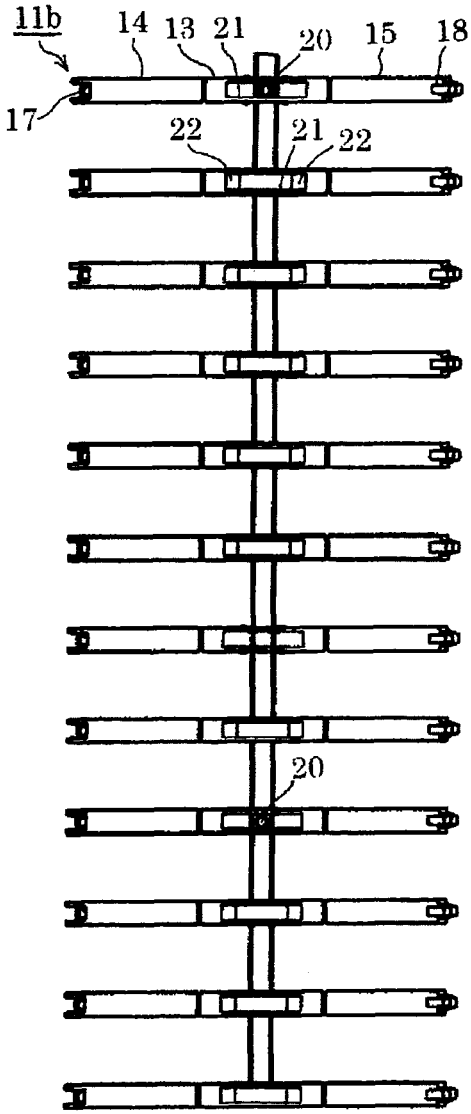
FIG. 4(*a*) is a back view of the binder shown in FIG. 1, showing the outer peripheral surface side of the binder.
Figure 4B:
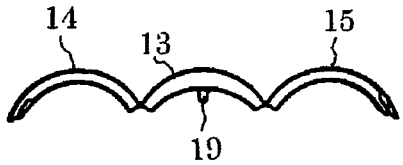

As shown in FIGS. 1, 3(*a*) and 3(*b*), in the central portion of the inner peripheral surface of the center ⅓ part that is situated in the center of the binder 11*b* in the longitudinal direction thereof as well as in the central portions of the inner peripheral surfaces of the center ⅓ ring parts that are respectively situated fourth from the two ends of the binder 11*b*, there are provided pins 19. Also, as shown in FIGS. 2 and 4(*a*), in the central portions of the outer peripheral surfaces of these three center ⅓ ring parts 13, there are formed pin holes 20 which respectively correspond to the pins 19. When a plurality of binders 11*b* are piled up on top of each other and the pins 19 and pin holes 20 thereof are fitted with each other, the plurality binders 11*b* are connected together in a piled-up manner.

In the other center ⅓ ring parts 13 than the above-mentioned three center ring parts 13 in which the pins 19 and pin holes 20 are formed, more specifically, in the portions of such center ⅓ ring parts 13 that intersect with the center line of the back part 12, there are formed rectangular penetration holes 21. These penetration holes 21 allow the center ⅓ ring parts 13 to deflect in the width direction thereof. Therefore, the penetration holes 21 can absorb an increase or a decrease in the distance between the center ⅓ ring parts 13. As a result of this, when, owing to the linear expansion of the binder 11*b* caused by a variation in its environmental temperature, stresses are applied to the binder 11*b* in the longitudinal direction thereof, the center ⅓ ring part 13 contracts or expands in the width direction thereof, thereby absorbing the stresses.

Figure 5A:
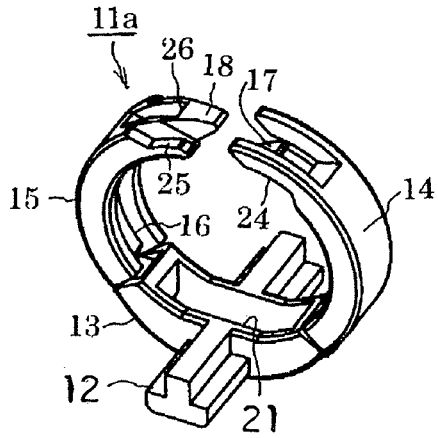
FIG. 5(*a*) is a perspective view of a small-diameter binder.
Figure 5B:
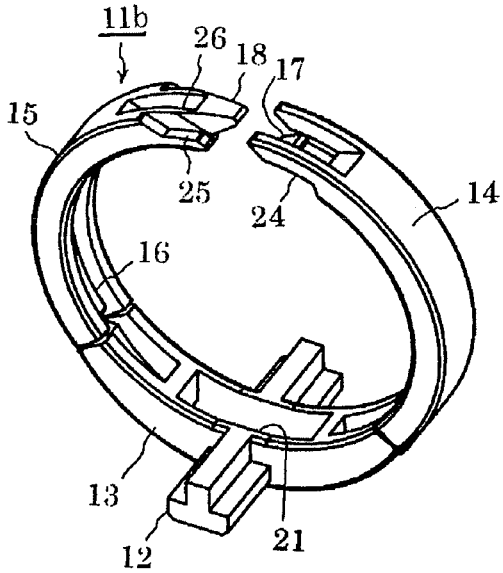

FIGS. 5(*a*) and 5(*b*) respectively show a state just before the ⅓ ring parts 14 and 15 of binders are folded and fitted with each other. Here, FIG. 5(*b*) shows the binder 11*b* that is shown in FIGS. 1 to 4(*b*), whereas FIG. 5(*a*) shows a binder 11*b* which is smaller in diameter than the binder 11*b*. The two binders 11*b* and 11*b* are equal to each other in the ring pitch and in the widths of the ring parts 13, 14 and 15 but are different from each other in the outside diameter and in the inside diameter, whereby, according to the number of sheets of paper to be bound, it is systematized such that a binder having a proper diameter can be selected and loaded into a binding processing machine for actual use.

Figure 6:
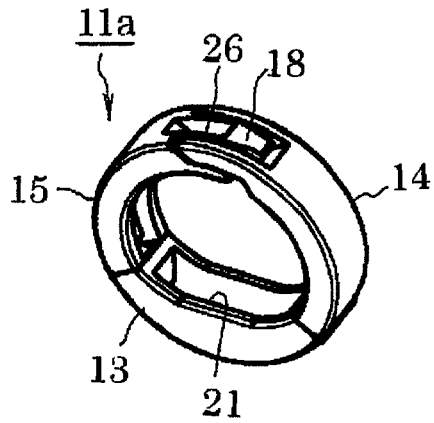
FIG. 6(*a*1) is a perspective view of a small-diameter binder with its fitting portion facing upward.
Figure 6:
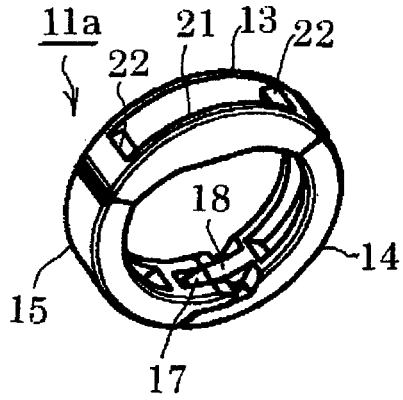
Figure 6:
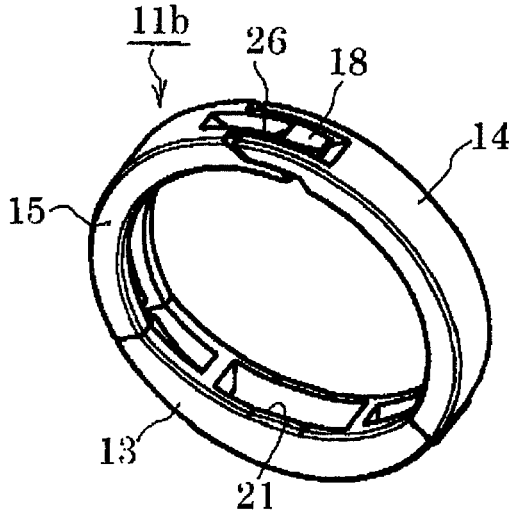
Figure 6:
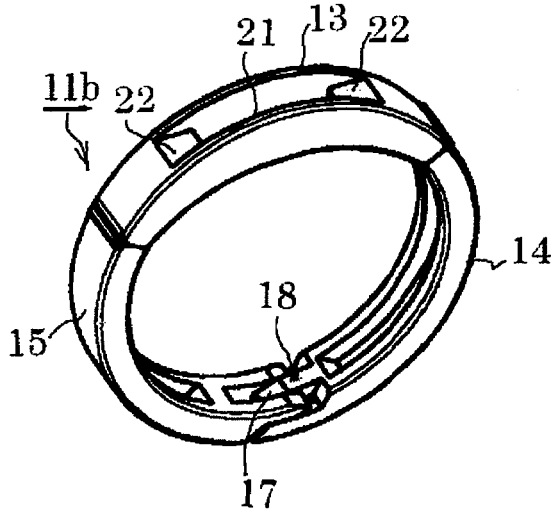

FIGS. 6(*a*1) to 6(*b*2) respectively show a state where the ⅓ ring parts 14 and 15 are fitted with each other (in these figures, the back part 12 is not shown). Specifically, FIGS. 6(*a*1) and 6(*b*1) respectively show states where their fitted portions face upward, whereas FIGS. 6(*a*2) and 6(*b*2) respectively shown states where their fitted portions face downward.

Figure 7:
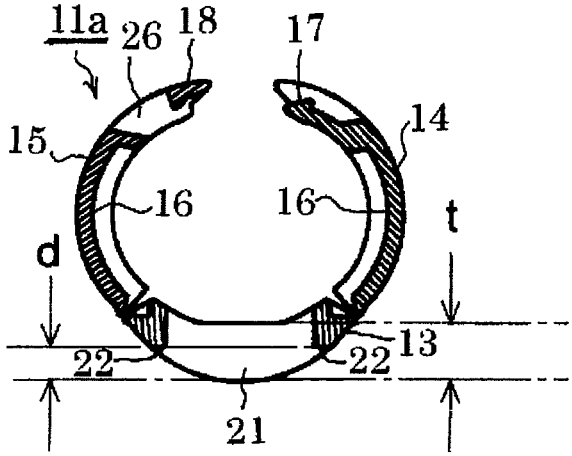
FIG. 7(*a*1) is a section view of a small-diameter binder just before it is fitted.
Figure 7:
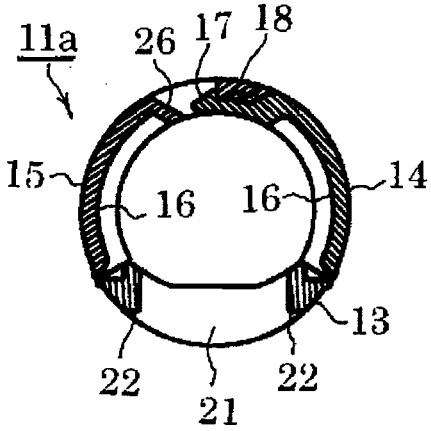
Figure 7:
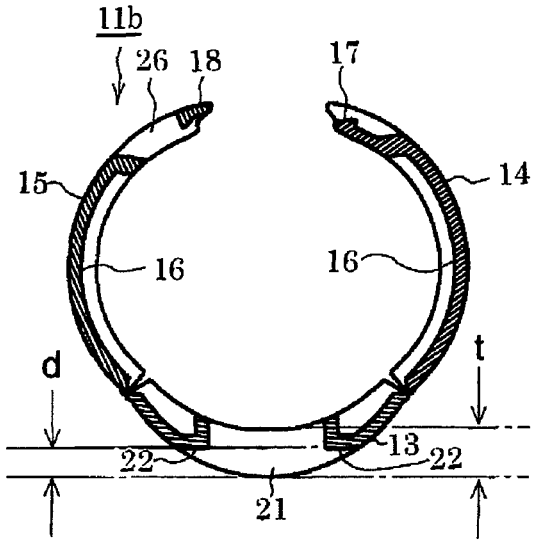
Figure 7:
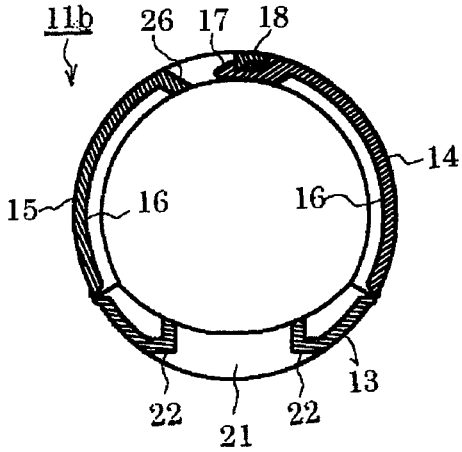

FIGS. 7(*a*1) and 7(*b*1) respectively show sections in a state just before fitting, while FIGS. 7(*a*2) and 7(*b*2) respectively show sections in a state of fitting. As shown in FIGS. 7(*a*1) and 7(*b*1), the two kinds of binders 11*a* and 11*b* having different ring diameters are equal to each other in the diameter direction thickness t of the central portions of the center ⅓ ring parts 13 thereof. A plane portion 22 is formed in the center ⅓ ring part 13. The plane portion 22 is formed to have such a shape that the central portion of the outer peripheral surface of the center ⅓ ring part 13 is cut out in a direction perpendicular to the normal of the peripheral surface with a width equal to the penetration hole 21. These two kinds of binders 11*a* and 11*b* are also the same in the distance d between their plane portions 22 and the tangent lines of the outer peripheral surfaces parallel to the plane portions 22.

Figure 8:
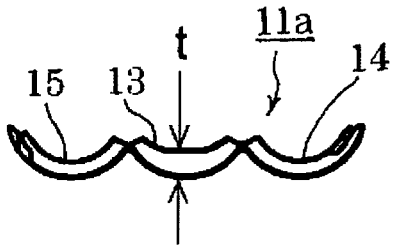
FIG. 8(*a*1) is a side view of a small-diameter binder.
Figure 8:
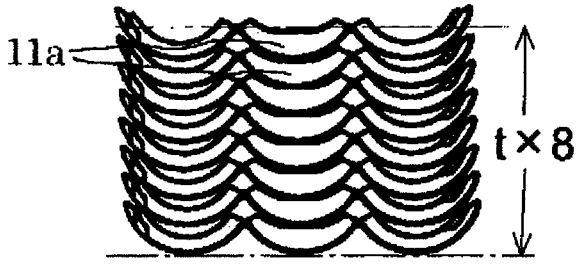
Figure 8:
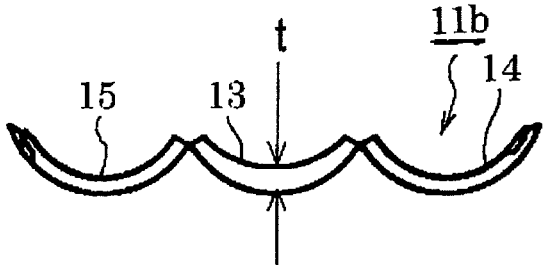
Figure 8:
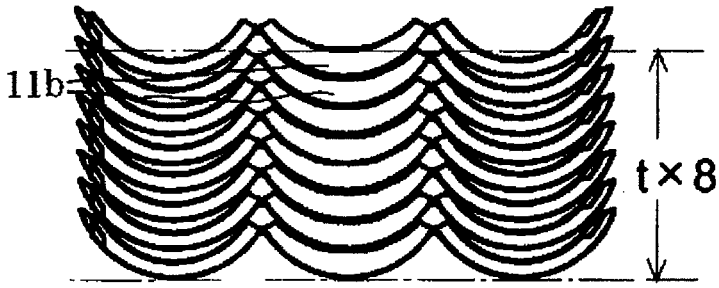

As shown in FIGS. 8(*a*1) and 8(*b*1), the two lads of binders 11*a* and 11*b* are the same in the thickness t of the center ⅓ ring parts 13 thereof and thus a plurality of binders can be piled up on top of each other closely with no clearance between them. Thus, as shown in FIGS. 8(*a*2) and 8(*b*2), when the binders 11*a* and 11*b* are piled up in the same number (in the present embodiment, the number of the binders 11*a* is eight and the number of the binders 11*b* is eight), their respective total thicknesses are the same. Therefore, in the binding processing machine, control on the amount of feeding of the binder within a cartridge, control on the detection of the remaining amount of the binder from the amount of movement of a pusher for pushing the binder for feeding, and other control can be standardized, thereby being able to simplify the processings to be carried out by the control part of the binding processing machine.

Figure 9:
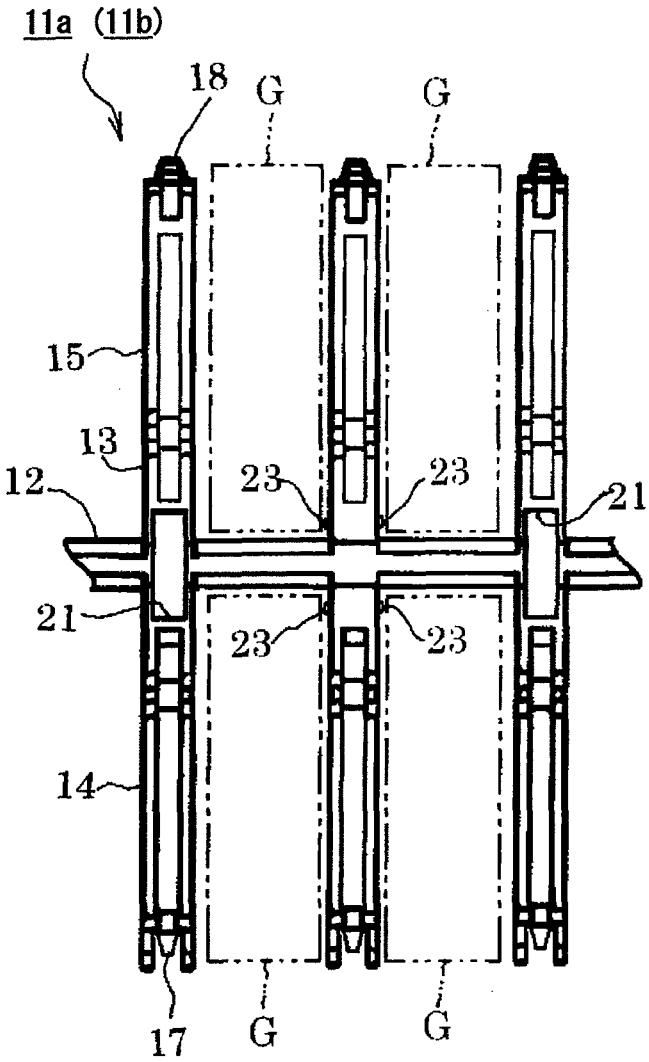
FIG. 9 is an enlarged view of the A portion shown in FIGS. 1 and 2.

FIG. 9 is an enlarged view of the A portion shown in FIGS. 1 and 2. In FIG. 9, on the two side surfaces of each of the three A portions respectively shown in FIG. 1 of the center ⅓ ring part 13, there are provided spherical-shaped projecting portions 23 which respectively function as position regulating portions. Although not shown, binders, which have been loaded into the cartridge of the binding processing machine in a piled-up manner, are regulated in the lateral movement thereof by feed guides G provided within the cartridge, whereby, in FIG. 9, they are fed in the far direction of the sheet of FIG. 9. Here, even when the binders are linearly expanded, as described above, an increase or a decrease in the distance between the center ⅓ ring parts 13 can be absorbed by the penetration holes 21, thereby being able to hold the positions of the ring parts at their regular positions. Also, even when the side surface of the binder is contacted with the wall surface of the feed guide G, the projecting portions 23 provided on the one or two side surfaces of one or more ring parts hold the side surface of the center ⅓ ring part in a state where it is in point contact with the wall surface of the feed guide, whereby the whole of the ring part is not surface contacted with the feed guide and thus the binder can be fed smoothly with low friction resistance.

Figure 10A:
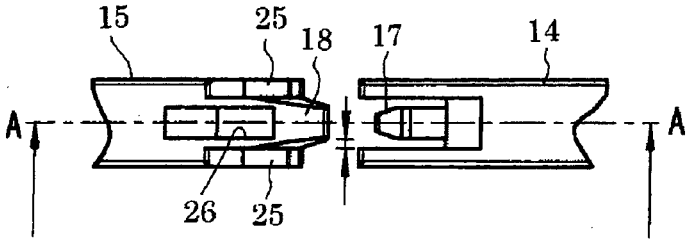
FIG. 10(*a*) is a plan view of a fitting mechanism provided on and between the leading ends of ring parts.
Figure 10B:
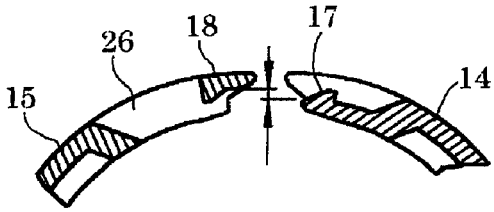
Figure 10C:
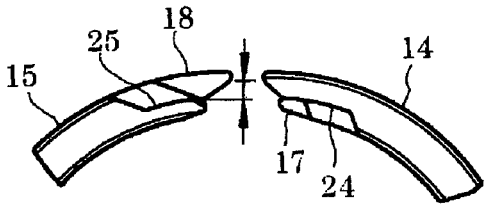

FIGS. 10(*a*) to 10(*c*) respectively show a fitting mechanism which is provided on the leading end of the ring part. As shown in FIGS. 10(*a*) and 10(*c*), step portions 24 are formed on the inner peripheral surfaces of the right and left portions of the ⅓ ring part 14 between which an upward rising hook portion 17 is provided. Step portions 25 are formed on the outer peripheral surfaces of the right and left portions of the ⅓ ring part 15 between which a catch portion 18 is provided. The step portions 25 respectively correspond to the step portions 24 of the other ⅓ ring part 14. When the step portions 24 and 25 are superimposed on top of each other, the two ⅓ ring parts 14 and 15 can be unified together. That is, the present fitting mechanism is configured as a scarf joint structure.

The hook portion 17 of the ⅓ ring part 14 is provided at a position which is retracted from its right and left step portions 24. Slits are provided between the hook portion 17 and the respective stepped portions 24, whereby the hook portion 17 is allowed to flex freely.

As regards the catch portion 18 of the other ⅓ ring part 15, the hook portion 17 can be engaged with the vertical wall of the rear end of the catch portion 18. The vertical wall of the catch portion 18 exists at a position retreated farther from the right and left step portions 25, whereas the leading end of the catch portion 18 projects forwardly beyond the step portions 25.

When the pair of mutually opposed ⅓ ring parts 14 and 15 are moved near to each other for fitting, firstly, the leading end of the catch portion 18 of one ⅓ ring part 15 moves into between the right and left step portions 24 of the other ⅓ ring part 14, thereby positioning the two ⅓ ring parts 14 and 15 in the lateral direction thereof. Further, the step portions 24 and 25 of the two ⅓ ring parts 14 and 15 are slidingly contacted with each other, thereby positioning the two ⅓ ring parts 14 and 15 in the vertical direction (radial direction) thereof. When further closing the two ⅓ ring parts 14 and 15, the upward facing pawl of the hook portion 17 is engaged with the vertical wall of the rear end of the catch portion 18, so that the hook portion 17 and catch portion 18 are connected to each other.

In this manner, when closing the two ⅓ ring parts 14 and 15, firstly, the leading end portions of these ring parts are positioned and, after then, the hook portion 17 and catch portion 18 are engaged with each other. This can eliminate a possibility that the two ring parts can be shifted in position from each other which may cause poor engagement between them.

A hole 26 is formed through the rear of the catch portion 18 of the ⅓ ring part 15. The hole 26 penetrates through the ⅓ ring part 15 in the radial direction thereof. Therefore, as shown in FIGS. 7(*a*2) and 7(*b*2), in the engaged state, the leading end of the hook portion 17 is exposed inside of the hole 26 and can be observed from outside. Thus, the hook portion 17 can be pressed down from above with a pin or the like to remove the engagement between the hook portion 17 and catch portion 18, thereby releasing the pair of ⅓ ring parts 14 and 15.

Also, as can be understood from FIGS. 7(*a*1) to 7(*b*2) as well as FIGS. 10(*b*) and 10(*c*), since the fitting mechanism between the pair of ⅓ ring parts 14 and 15 is formed to have such a section shape as does not include any undercut portion, the two ⅓ ring parts 14 and 15 can be molded without using a slide core die which is complicated in structure.

When the pair of ⅓ ring parts 14 and 15 fitted with each other are pushed and spread, e.g., by a finger, the hook portion 17 is elastically deformed due to stress caused by such spreading, thereby being able to release the pair of ⅓ ring parts 14 and 15 from each other. Therefore, although a hole corresponding to the hole 26 may not be formed as in a binder 31 shown in FIG. 11(*a*), provision of such hole makes it possible to release the two ring parts from each other without applying extension stress on the hook portion 17. This can provide an advantage that it is less likely to damage the hook portion 17.

Figure 11A:
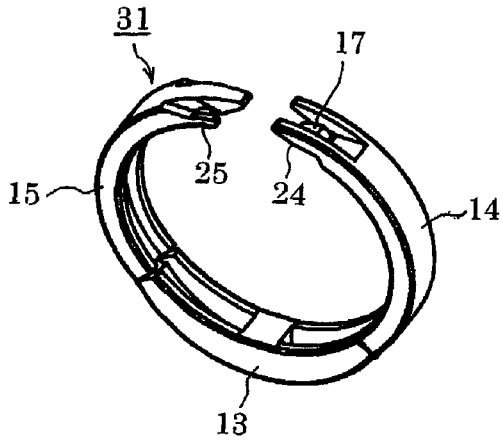
FIG. 11(*a*) is a perspective view of another embodiment of a binder according to the invention.
Figure 11B:
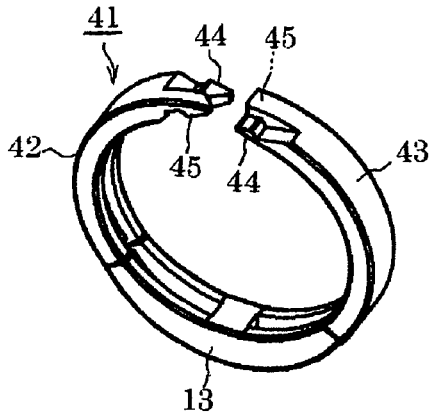

FIG. 11(*b*) shows another embodiment of a binder according to the invention, in which a pair of ⅓ ring parts 42, 43 of a binder 41 is symmetrical in shape. The half portions of the leading ends of the two ring parts 42, 43 are respectively formed as upward facing hook portions 44, whereas the other half portions are respectively formed as downward facing hook portions 45. When the paired ⅓ ring parts 42, 43 are closed, the mutually opposed upward facing hook portions 44 and downward facing hook portions 45 are engaged with each other, thereby coupling the pair of ⅓ ring parts 42, 43 together.

The upward facing hook portion 44 and downward facing hook portion 45 may not be always formed in the leading ends of all of the ⅓ ring parts 42, 43, but the hook portions 44 and 45 may also be formed only in the leading ends of the ring parts provided on the longitudinal-direction two ends of the binder as well as the important ring parts provided between the two ends of the binder.

Figure 12:
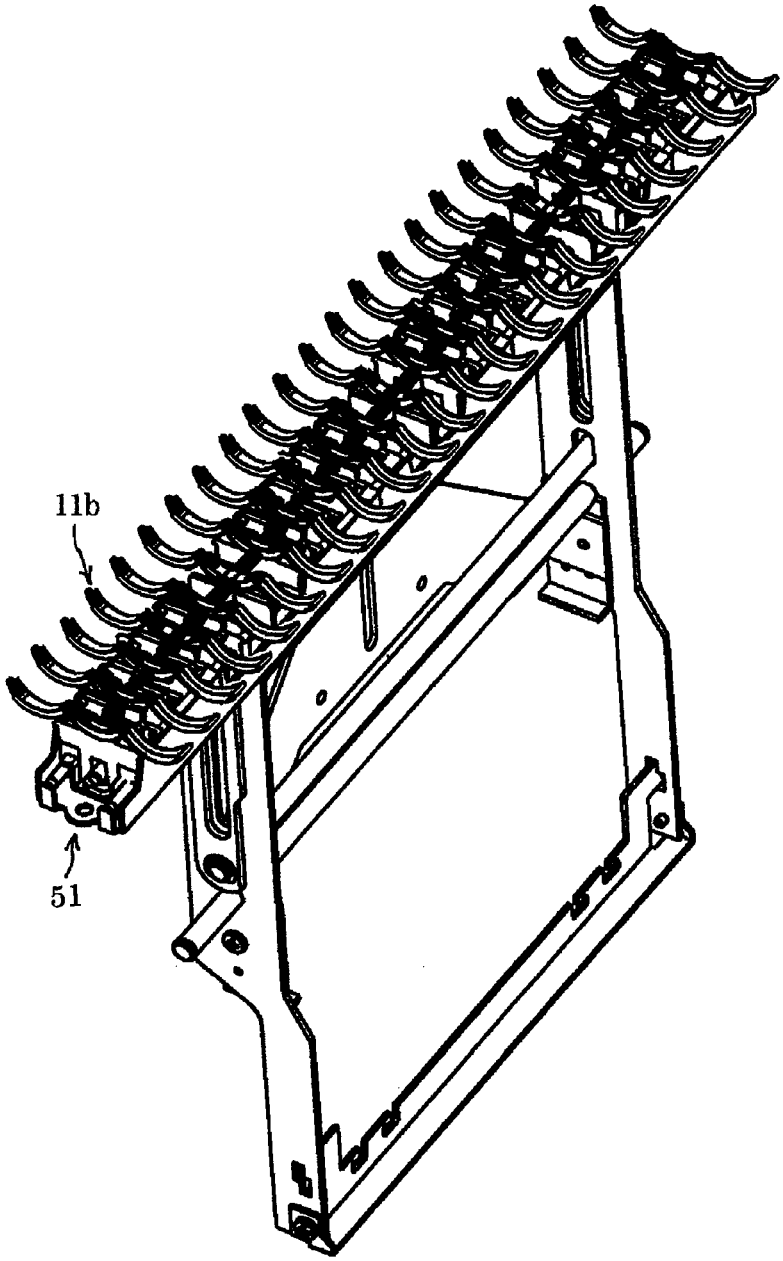
FIG. 12 is a perspective view of a binder pickup unit incorporated in an automatic binding processing machine.
Figure 13:
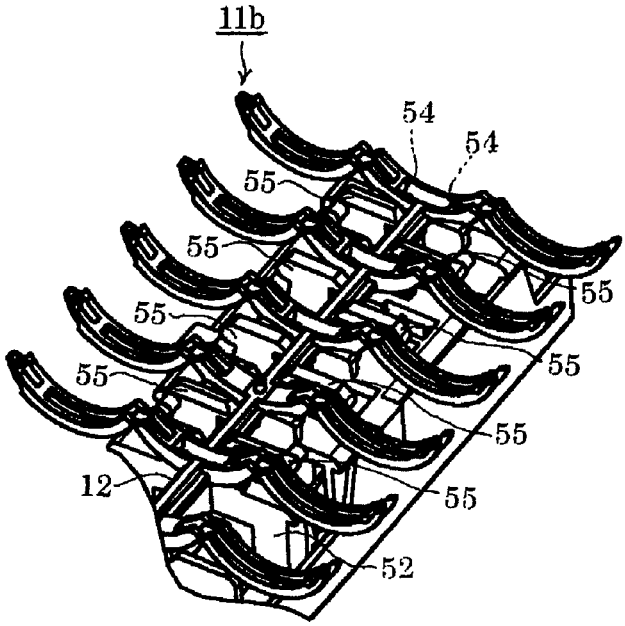
FIG. 13 is a partially enlarged view of FIG. 12.

FIGS. 12 and 13 respectively show a state where a binder pickup unit 51 of a binding processing machine holds a binder 11*b*. While a binding processing machine may be structured in various manners, the binder pickup unit 51 is an example of means for taking out one binder from a cartridge in which a large number of binders are loaded in a piled-up manner, and supplying the binder into a binding processing mechanism part into which papers is to be mounted.

Figure 14:
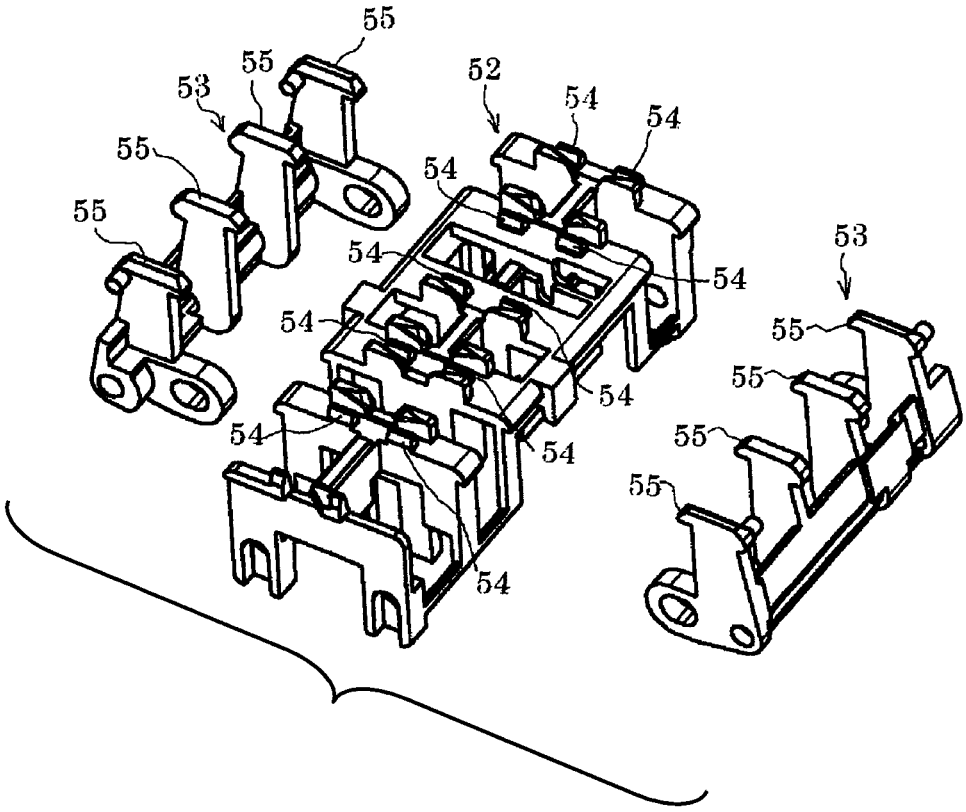
FIG. 14 is an exploded view of the composing members of the binder pickup unit.

The binder pickup unit 51 includes a table block 52 shown in FIG. 14 and two hook lever blocks 53 respectively disposed on the front and rear surfaces of the table block 52, while the table block 52 and hook lever blocks 53 are respectively assembled to a frame (not shown). On the upper surface of the table block 52, there are provided plane tables 54 at the same pitch as the ring pitch of the binders 11*a* and 11*b* respectively shown in FIGS. 7(*a*1) to 7(*b*2), while the upper surfaces of the plane tables 54 respectively receive the plane portions 22 of the center ⅓ ring parts 13 of the binders 11*a* and 11*b*. Each of the paired front and rear hook lever blocks 53 includes a plurality of hook levers 55 which are arranged in a comb teeth shape at the same pitch as the ring pitch. The mutually opposed hook levers 55 are interposed zigzag between the plane tables 54, can be opened and closed symmetrically by a lever opening/closing mechanism (not shown) and, when they are closed, can hold the step portion of the T-section back part 12 of the binder 11*a* or 11*b*.

Figure 15:
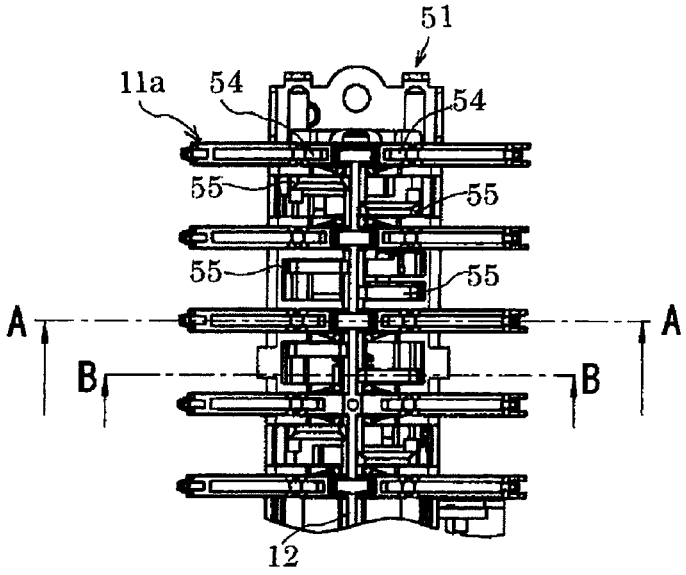
FIG. 15(1) is a front view of the binder pickup unit, showing a state in which it holds a binder.
Figure 15:
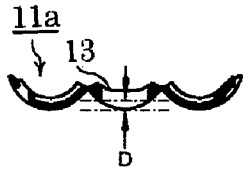
Figure 15:
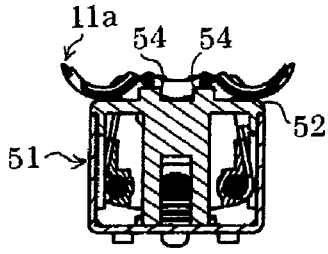
Figure 15:
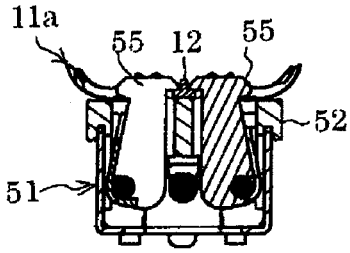
Figure 15:
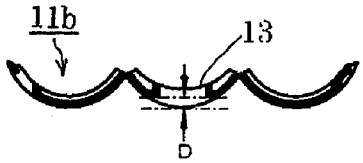
Figure 15:
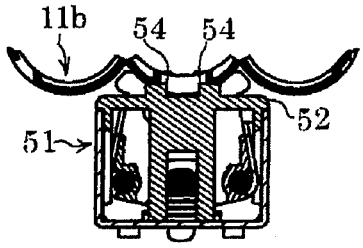
Figure 15:
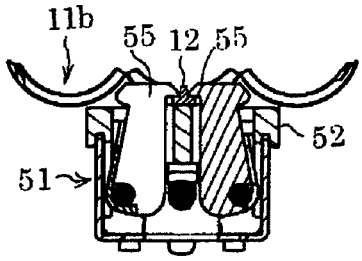

FIGS. 15(1) to 15(*b*2) respectively show the details of the binder pickup unit 51. Specifically, FIG. 15(1) shows a state thereof in which the binder pickup unit 51 grabs or holds the binder 11*a* or 11*b*, FIG. 15(*a*0) shows the binder 11*a*, and FIGS. 15(*a*1) and 15(*a*2) are section views of the binder pickup unit 51, respectively showing the states thereof where the binder pickup unit 51 grabs the binder 11*a*. Also, FIG. 15(*b*0) shows the binder 11*b*, and FIGS. 15(*b*1) and 15(*b*2) are section views of the binder pickup unit 51, respectively showing the states thereof in which the binder pickup unit 51 grabs the binder 11*b*.

As described above, in the two kinds of binders 11*a* and 11*b*, since the distances d between the plane portions 22 thereof and the tangents of the outer peripheral surfaces thereof are the same, the position relationships between the plane portions 22 and back parts 12 are also the same. Therefore, as shown in FIGS. 15(*a*2) and 15(*b*2), the paired front and rear hook levers 55, regardless of the sizes of the binders, can be respectively engaged with the step portions of the back part 12 having a T-shaped section to thereby press the back part 12 against the table block 52. Further, the plane portions 22 can also be pressed against the plane tables 54 of the table block 52.

Since there are formed the plane portions 22 in the binders 11*a* and 11*b* and the plane portions 22 can be received by the plane tables 54 of the table block 52, the binders 11*a* and 11*b* can be prevented from inclining in orientation, whereby they can be held stably in their regular orientations. Also, because the right and left sides of the plane portions 22 of the binders 11*a* and 11*b* are surrounded by the side walls of the center ⅓ ring parts 13, when the plane tables 54 of the table block 52 are fitted with the plane portions 22, the longitudinal-direction positioning of the binders 11*a* and 11*b* can be attained. Also, since, as described above, the penetration holes 21 are formed in the respective center ⅓ ring parts 13 to allow the flexing of the ring parts 13 in the width direction thereof; even when the whole lengths of the binders 11*a* and 11*b* are extended due to variations in heat, the plane portions 22 of the center ⅓ ring parts 13 are fitted with the plane tables 54 of the table block 52 to thereby correct the deviation of the ring pitch forcibly. Accordingly, the binding processing can be carried out at a regular ring pitch.

Meanwhile, the present invention is not limited to the above-mentioned embodiments but various alterations are also possible without departing from the technological scope of the invention, and it is apparent that such alterations fall within the scope of the invention.

While the present invention has been described heretofore with reference to its specific embodiments, it is obvious to a person skilled in the art that various changes and modifications are also possible without departing from the spirit and scope of the invention.

The present application is based on the Japanese Patent Application (No, 2005-216314) filed on Jul. 26, 2005, a content of which is incorporated herein by reference.

INDUSTRIAL APPLICABILITY

The present invention can resolve a poor mounting of a binder caused by a linear expansion of the binder.

The invention claimed is:

1. A one-piece plastic binder for binding sheets of paper, comprising:

a plastic back part; and a plurality of plastic rings arranged at certain intervals along a longitudinal axis of the back part to align with holes punched in the sheets of paper, each of the rings being formed of ring parts on respective sides of the back part, and each of the rings being openable and closable, wherein the plurality of rings are coupled together through the back part being disposed between side surfaces of the respective adjacent rings, and at least one of the plastic rings is formed with only one, unbroken unitary penetration hole that intersects the longitudinal axis of the plastic back part and absorbs a linear expansion of the binder in a longitudinal direction thereof along the longitudinal axis of the back part to maintain the plurality of rings aligned with the holes punched in the sheets of paper, wherein the penetration hole extends in a radial direction of the at least one of the rings from a radially inner surface to a radially outer surface of the at least one of the rings.

2. The binder according to claim 1, wherein each of the rings comprises:

a center ⅓ ring part coupled to the back part; and

⅓ ring parts hinge-connected to respective ends of the center ⅓ ring part, wherein the center ⅓ ring part of the at least one of the rings is formed with the penetration hole.

3. The binder according to claim 1, further comprising a position regulating portion disposed on the side surface of at least one of the rings, wherein the position regulating portion is operable to contact with a wall surface of a binder guide of a binding processing machine to regulate a position of the rings.

4. The binder according to claim 3, wherein the position regulating portion comprises a projecting portion having a spherical shape.

5. A binder configured for a binding processing machine, comprising:

a one-piece structure, the one-piece structure comprising a back part;

a plurality of rings arranged at certain intervals along a longitudinal axis of the back part, each of the rings being formed of ring parts on respective sides of the back part, and each of the rings being openable and closable; and a plurality of position regulating projecting portions disposed on lateral side surfaces of at least one of the rings and extending in the direction of the longitudinal axis of the back part, the position regulating projecting portions being arranged on the respective sides of the back part and being symmetrically arranged with respect to the longitudinal axis of the back part, the position regulating projecting portions being configured to contact with a wall surface of a binder guide of the binding processing machine to regulate a position of the rings when the binder is loaded into the binding processing machine such that the binder guide is arranged between the side surface of the at least one of the rings and a side surface of an adjacent one of the rings and contact between the wall surface of the binder guide and the side surfaces of the respective rings is reduced to reduce friction resistance between the wall surface of the binder guide and the side surfaces of the respective rings.

6. The binder according to claim 5, wherein the position regulating projecting portions have a spherical shape configured to contact with the wall surface of the binder guide.

* * * * *